US005607022A

United States Patent [19]

Walker et al.

[11] Patent Number: 5,607,022

[45] Date of Patent: Mar. 4, 1997

[54] CONCRETE DROP HAMMER ATTACHMENT DEVICE

[76] Inventors: Leon R. Walker, Rte. 4, Box 231-A, Claremore, Okla. 74017; Thomas P. Clark, 7407 S. 70th East Ave., Tulsa, Okla. 74133

[21] Appl. No.: 401,957

[22] Filed: Mar. 10, 1995

[51] Int. Cl.[6] ..... B25D 9/00

[52] U.S. Cl. ..... 173/10; 173/114; 173/211; 173/89

[58] Field of Search ..... 173/10, 11, 13, 173/14, 15, 24, 45, 82, 83, 84, 89, 90, 112, 114, 125, 152, 201, 207, 211

[56] References Cited

U.S. PATENT DOCUMENTS

| | | | |
|---|---|---|---|
| 2,659,583 | 11/1953 | Dorkins | 262/13 |
| 3,658,139 | 4/1972 | Von Ruden | 173/124 |
| 4,439,056 | 3/1984 | Reilly et al. | 173/90 X |
| 4,634,311 | 1/1987 | Jinnings et al. | 173/89 X |
| 4,852,661 | 8/1989 | Ellington | 173/84 |
| 5,012,873 | 5/1991 | Kennedy et al. | 173/184 |
| 5,291,955 | 3/1994 | Clark | 173/24 |
| 5,490,740 | 2/1996 | Johnson | 173/200 X |

*Primary Examiner*—Scott A. Smith
*Assistant Examiner*—Jay A. Stelacone
*Attorney, Agent, or Firm*—Molly D. McKay, P.C.

[57] ABSTRACT

A device removably attaches to a skid steer and is used for breaking up asphalt, concrete, etc. A hollow rod is suspended from the device, and a nipple provides liquid communication to the interior rod chamber of the hollow rod. A head is provided on a lower end of the rod and a cylinder is movably provided around the rod's lower end so that upper and lower cylinder chambers are formed within the cylinder, above and below the head. Perforations provided in the lower end of the rod provide liquid communication between the rod chamber and the upper cylinder chamber. The lower cylinder chamber is charged with gas. A weight and a breaking tool attach to the bottom end of the cylinder and move upward and downward in conjunction therewith. A switch provided on the frame is tripped as the weight is raised, thus sending an electrical impulse to a timer, causing it to momentarily supply electricity to dump and directional valves, simultaneously closing them. The timer then resets and removes electricity from the valves, allowing them to simultaneously reopen. When the dump and directional valves are open, hydraulic fluid is pumped into the upper cylinder chamber and the weight is lifted. When both valves close, the dump valve quickly drains the upper cylinder chamber, thus causing the weight and the breaking tool to fall to the ground.

8 Claims, 7 Drawing Sheets

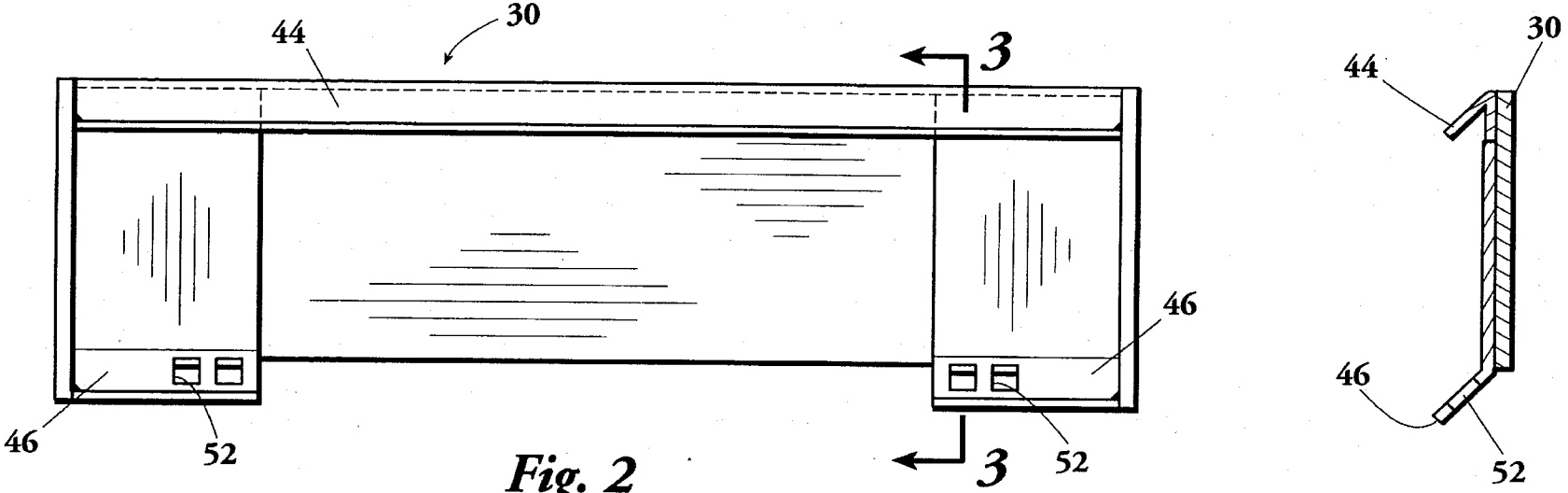
Fig. 2
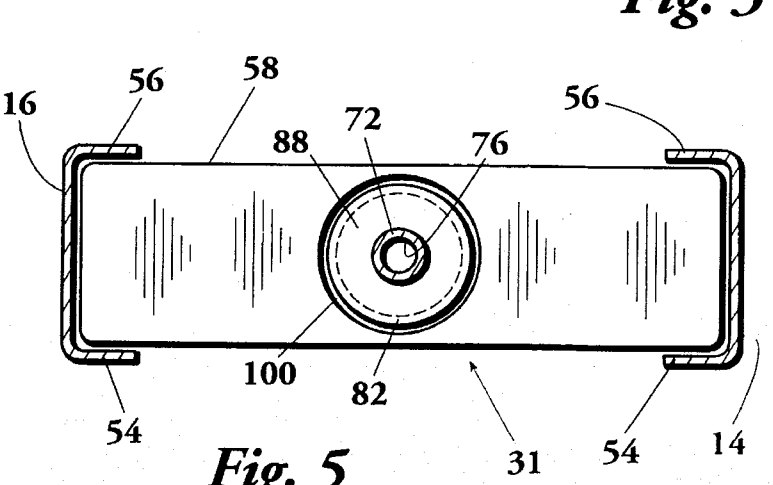
Fig. 3
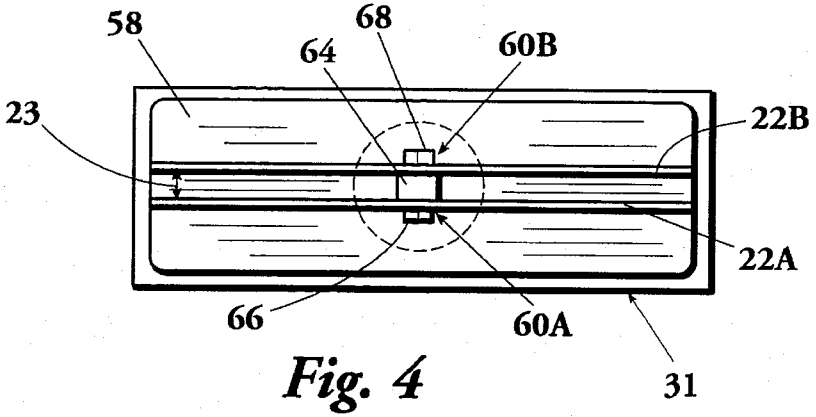
Fig. 4
Fig. 5

CONCRETE DROP HAMMER ATTACHMENT DEVICE

BACKGROUND OF THE INVENTION

1. Field of the Invention

The present invention relates to an attachment device for a skid steer. More specifically, the invention relates to a concrete drop hammer for breaking up concrete, asphalt, etc. which mounts onto and is moved about by a skid steer.

2. Description of the Related Art

The surfaces of roadways and parking lots generally are paved with asphalt or with concrete slabs. Whenever these surfaces must be partially removed, as is necessary when the surfaces require repair, or must be complete removed, special dedicated equipment is normally needed to accomplish this task. These special dedicated pieces of equipment generally require a substantial investment to purchase and cannot be used for other tasks once the job of breaking up the surface is done.

The present invention addresses this problem by providing a device which removably attaches to a skid steer and when attached thereto functions to break up a surface. Because the device is moved about by the skid steer instead of under its own power, the device can be manufactured at less cost and those cost savings can be passed along to the consumer through lower purchase prices. Another advantage of the present device is that it can be operated by anyone who is familiar with the operation of a skid steer and does not require special training to learn to operate the device. Also, the device can be detached from the skid steer and the skid steer can be used for a variety of other tasks.

SUMMARY OF THE INVENTION

Briefly, the present invention is a device which removably attaches to the front end of a skid steer and converts the skid steer into a concrete drop hammer. The device is provided with a vertically oriented frame comprised of two spaced apart upright frame members connected together at their upper ends by a pair of parallel, spaced apart upper frame members and connected together at their lower ends by a lower frame member. Each of the upright frame members is provided with an inwardly extending front extension and an inwardly extended rear extension so that in cross section the upright frame members are "U" shaped. A weight is movably captured within the two "U" shaped upright frame members.

Each of the upper frame members is provided with an opening such that a category inserts in the gap formed between the upper frame members and an eye provided in the category is aligned with the openings. A supporting bolt can be inserted first through one opening, then through the eye and finally through the other opening before a nut is threaded onto the supporting bolt to fasten the bolt therein. The category is secured to an upper closed end of a hollow rod. A nipple which communicates with the hollow interior rod chamber of the hollow rod is also provided on the upper end of the hollow rod. A lower end of the hollow rod is provided with an enlarged head which is movably captured within a cylinder, such that the lower end of the hollow rod always remains within the cylinder. The hollow rod extends out through a cylinder opening provided in a top end of the cylinder and the upper end of the hollow rod is external to the cylinder. An end gland is provided at the cylinder opening and forms a gas and liquid tight seal between the cylinder and an external surface of the hollow rod.

Internally, the cylinder is provided with two gas and liquid tight compartments, i.e., the upper cylinder chamber and the lower cylinder chamber. The two cylinder chambers are separated from each other by the movable head. The lower end of the hollow rod is provided with perforations which provide fluid communication between the hollow interior rod chamber and the upper cylinder chamber. A gas valve which communicates with the lower cylinder chamber is provided at the closed bottom end of the cylinder as a means for charging the lower cylinder with a gas. The bottom end of the cylinder is provided externally with a downward oriented appendage in which a bar opening is provided.

The weight is provided with an upwardly opening cavity into which the appendage extends. The walls of the cavity are provided with weight openings which align with each other and with the bar opening in the appendage. A bar bolt inserts first through one of the weight openings, next through the bar opening and finally through the other weight opening before being secured therein by a bar bolt nut which engages a threaded end of the bar bolt.

A lower surface of the weight is provided with a downwardly oriented hollow sleeve into which an upper end of a breaking tool inserts. The upper end of the breaking tool is provided with a notch therein which aligns with a pair of sleeve openings provided in the sleeve. A tool retaining bolt inserts first through one of the sleeve openings, next through the notch and finally through the other sleeve opening before a tool retaining nut engages a threaded end of the tool retaining bolt as a means of securing it therein. A pair of depressions are provided externally in the sleeve so one depression is surrounding each of the sleeve openings and so that a head of the tool retaining bolt and the tool retaining nut reside within the depressions and are thereby protected from damage when the weight and attached breaking tool fall to the ground. The lower frame member is "U" shaped, as viewed from above, with its legs of the "U" shape being provided on either side of the device and the bottom portion being provided at a rear end of the skid steer. As the weight falls, the breaking tool passes through the open portion of the "U" shaped lower frame member, i.e. , between the legs of the "U" shaped lower frame member. Stops are provided on a top surface of each of the legs in order to cushion the impact of the weight with the frame in the event there is no surface below the device for the breaking tool to impact when the weight falls.

A first hydraulic line connects the nipple to a dump valve, a second hydraulic line connects the dump valve to a directional valve and a third hydraulic line connects the directional valve to a hydraulic tank located on the skid steer.

A trip switch is attached to one of the upright frame members such that the switch is tripped by the weight as the weight is lifted upward. The trip switch connects by means of an electrical connection to an electrical power supply provided on the skid steer. When the trip switch is tripped by the weight, an electrical impulse is sent from the switch to the timer via a second electrical connection to activate the timer. When activated, the timer momentarily supplies electricity via a third electrical connection to both the normally open dump valve and the normally open directional valve, thus simultaneously closing both valves. The timer will continue to supply electricity to the valves for only approximately a second before it resets itself, thereby removing electricity simultaneously from both valves, allowing them to reopen.

When the directional valve closes, hydraulic fluid is returned to the tank from the directional valve via a recycle line which extends between the directional valve and the tank. When the dump valve closes, hydraulic fluid in the upper cylinder chamber rapidly flows out through the perforations, then through the hollow interior rod chamber, out the nipple, through the first hydraulic line, through the dump valve and back to the tank via a dump line which extends between the dump valve and the tank.

BRIEF DESCRIPTION OF THE DRAWINGS

FIG. 2 is an enlarged rear elevation of a mounting plate of the concrete drop hammer attachment device of FIG. 1, shown detached from the device.

FIG. 3 is a cross-sectional view taken along line 3—3 of FIG. 2.

FIG. 4 is a top plan view of FIG. 1, showing the device with its mounting plate and runners removed.

FIG. 5 is a cross:sectional view taken along line 5—5 of FIG. 1, showing the device with its mounting plate removed.

DETAILED DESCRIPTION OF THE PREFERRED EMBODIMENT

Figure 1:
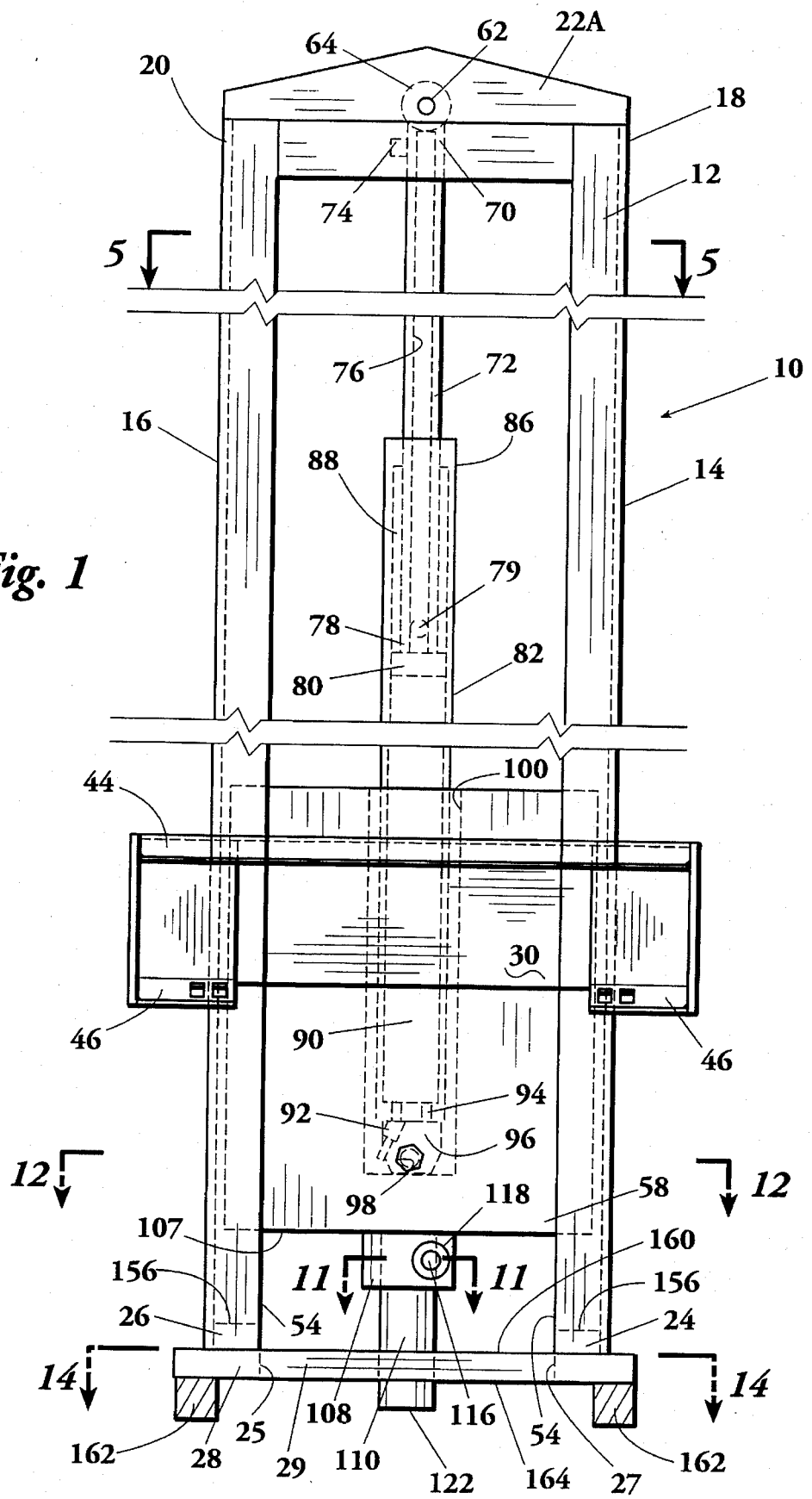
FIG. 1 is a rear elevation of a concrete drop hammer attachment device constructed in accordance with a preferred embodiment of the present invention.

Referring now to the drawings and initially to FIG. 1, there is illustrated a concrete drop hammer attachment device 10, constructed according to a preferred embodiment of the present invention. The device 10 is provided with a vertically oriented frame 12 consisting of two upright frame members, 14 and 16, each of which are generally perpendicular with the ground and generally parallel with each other. Upper ends, 18 and 20 respectively, of upright frame members 14 and 16 attach one to either end of a pair of upper frame members 22A and 22B. The upper frame members 22A and 22B are generally parallel with each other and spaced apart so as to form a gap 23 therebetween. Opposite lower ends, 24 and 26 respectively, are provided on upright frame members 14 and 16. The lower ends 24 and 26 attach respectively to legs 25 and 27 of a "U" shaped lower frame member 28 such that the upper and lower frame members, 22 and 28, are generally parallel with each other and also generally parallel with the ground. A bottom portion 29 of a lower frame member 28 is provided at a rear end 31 of device 10 so that it extends between the two legs 25 and 27 to form the "U" shaped lower frame member 28.

Figures 6, 7:
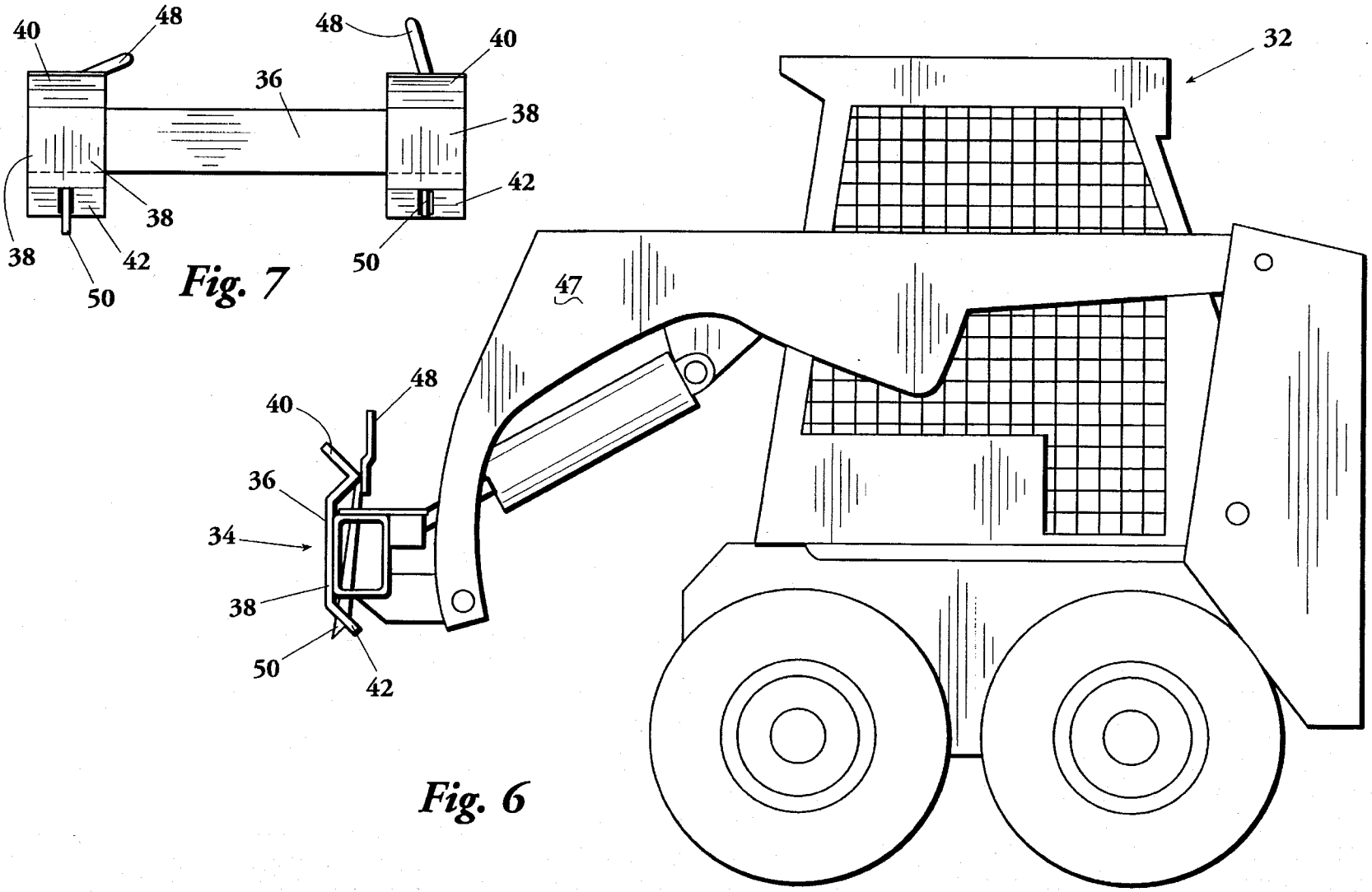
FIG. 6 is a left side elevation of a skid steer onto which the concrete drop hammer attachment device may be mounted.
FIG. 7 is a front elevation of a mounting bracket of the skid steer of FIG. 6, shown with one handle locked down and one handle swung upward to an unlocked position.

As illustrated in FIGS. 1, 2 and 3, a mounting plate 30 is secured to the upright frame members 14 and 16 as a means for mounting the device 10 to a skid steer 32, such as the skid steer 32 illustrated in FIG. 6. Referring now also to FIG. 7, the skid steer 32 is provided on its front end 34 with a mounting bracket 36. The mounting bracket 36 is provided with front plates 38, each having a top lip 40 which extends forward and upward at an angle and having a bottom lip 42 which extends rearward and downward at an angle.

The mounting plate 30 of the device 10 is provided with a top edge 44 which extends forward and downward at an angle and is provided with bottom edges 46 which also extend forward and downward.

In order to mount the device 10 on the Skid steer 32, the skid steer 32 is maneuvered forward and arms 47 of the skid steer 32 on which the mounting bracket 36 is attached, are lowered so that the mounting bracket 36 abuts the mounting plate 30 provided on the device and the top lip 40 of the mounting bracket 36 is below the top edge 44 of the mounting plate 30. Once in this position, the arms 47 are raised. This raises the mounting bracket 36 so that its top lip 40 engages the top edge 44 of the mounting plate 30 and the bottom lip 42 engages the bottom edges 46, thus raising the mounting plate 30 and the attached device 10 off the ground.

At this point, it is desirable to lock the device 10 onto the skid steer 32. This is accomplished by lowering a pair of levers 48 provided one on either side of the mounting bracket 36. These levers 48 were previously raised before the skid steer 32 was maneuvered toward the device 10. These levers 48 are each provided with a tongue 50 which is raised and lowered in response respectively to the raising and lowering of its associated lever.

As illustrated in FIG. 7, when raised, the tongues 50 are above the bottom lip 42, and when lowered, the tongues 50 extend below the bottom lip 42. The bottom edges 46 of the mounting plate 30 are provided with lock openings 52. The tongues 50 extend downward, when lowered, into any pair of the lock openings 52 in order to lock the mounting plate 30 to the mounting bracket 36.

The device 10 can be detached from the skid steer 32 by reversing these steps, i.e., raising both of the levers 48 to unlock the device 10 from the skid steer 32, lowering the arms 47 until the top lip 40 is below the top edge 44, and then maneuvering the skid steer 32 backward away from the device 10.

As illustrated in FIGS. 1 and 5, each of the upright frame members 14 and 16 has an inward extending front extension 54 and an inwardly extending rear extension 56 so that when viewed in cross section, each upright frame member 14 and 16 appears "U" shaped. A weight 58 iS movably retained between these "U" shaped frame members 14 and 16 as will be more fully explained hereafter.

The upper frame members 22A and 225 are each provided with an opening, 60A and 60B respectively, approximately midway between their ends. As illustrated in FIG. 4, openings 60A and 60B are aligned so that an eye 62 of a category 64 inserts into the gap 23 and a supporting bolt 66 extends sequentially through one of the openings, either 60A or 60B, then through the eye 62 and finally through the other opening, either 60B or 60A. The supporting bolt 66 is secured within openings 60A and 60B and the eye 62 by means of a nut 68 which fastens onto a threaded end of the supporting bolt 66.

As shown in FIGS. 1, 8, 9 and 10, the category 64 is attached to a closed upper end 70 of a hollow rod 72. The upper end 70 is also provided externally with a nipple 74 which communicates with a hollow interior rod chamber 76 of the rod 72. An opposite lower end 78 of the rod 72 is provided with a pair of perforations 79 which provide fluid communication into and out of the lower end 78. Also, the lower end 78 is provided with an enlarged head 80 located below the perforations 79. The enlarged head 80 is movably captured within a hollow cylinder 82. The rod 72 extends out through a cylinder opening 84 provided on a top end 86 of the cylinder 82 so that the upper end 70 of the hollow rod 72 is external to the cylinder 82. As shown diagrammatically in FIG. 8, the cylinder opening 84 is provided with an end gland 87 which creates a liquid-tight seal between the cylinder opening 84 and the rod 72.

The head 80 of the rod 72 separates the hollow cylinder 82 into two separate liquid and gas-tight hollow cylinder chambers: an upper cylinder chamber 88 and a lower cylinder chamber 90. The rod 72 is held by the supporting bolt 66 stationary with respect to the frame 12. The cylinder 82 is movable upward and downward with respect to the rod 72, moving upward when hydraulic pressure $P_1$ in upper cylinder chamber 88 is greater than gas pressure $P_2$ in the lower cylinder chamber 90. The respective volumes of the chambers 88 and 90 vary with the upward and downward movement of the cylinder 82 relative to the rod 72.

The hydraulic pressure $P_1$ is created within upper cylinder chamber 88 by hydraulic fluid which enters the rod chamber 76 by way of the nipple 74 and then flows into the upper cylinder chamber 88 from the rod chamber 76 via the perforations 79. Likewise, hydraulic fluid located within the upper cylinder chamber 88 exits the device 10 by flowing through the perforations 79, through the rod chamber 76 and out the nipple 74. The flow of hydraulic fluid into and out of the upper cylinder chamber 88 will be explained more fully hereafter.

Figure 9:
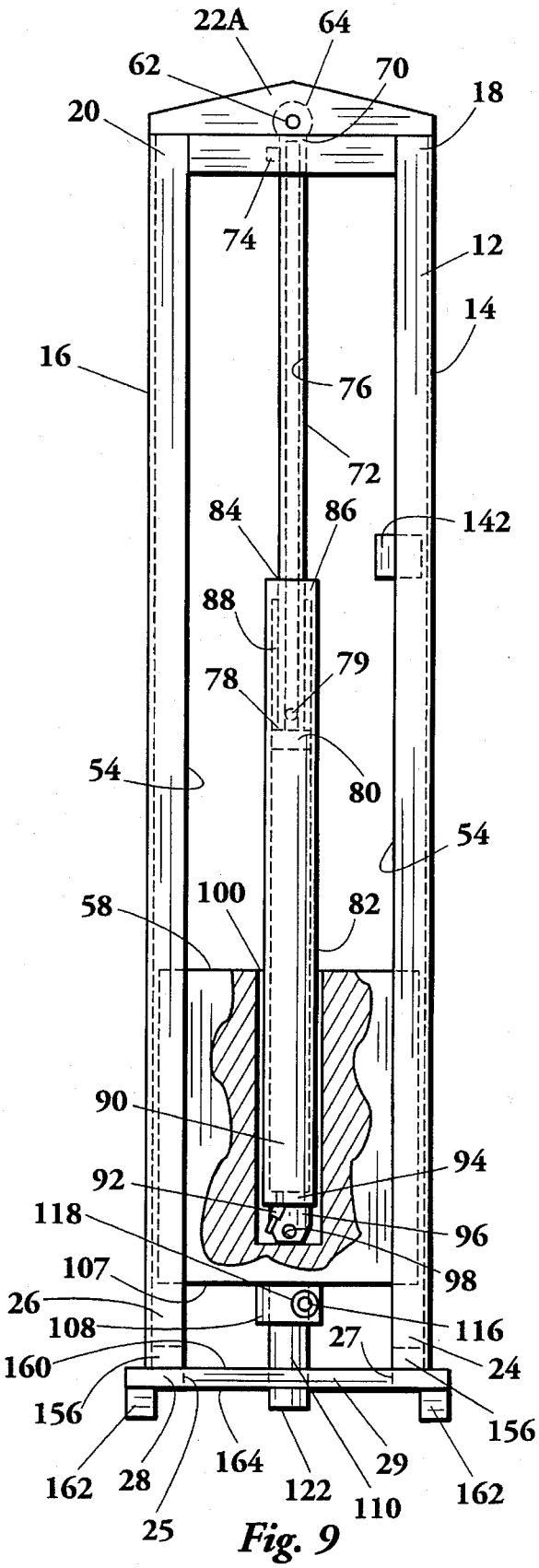
FIG. 9 is a partly cut away rear elevation of the concrete drop hammer attachment device, illustrating the weight lowered.
Figure 10:
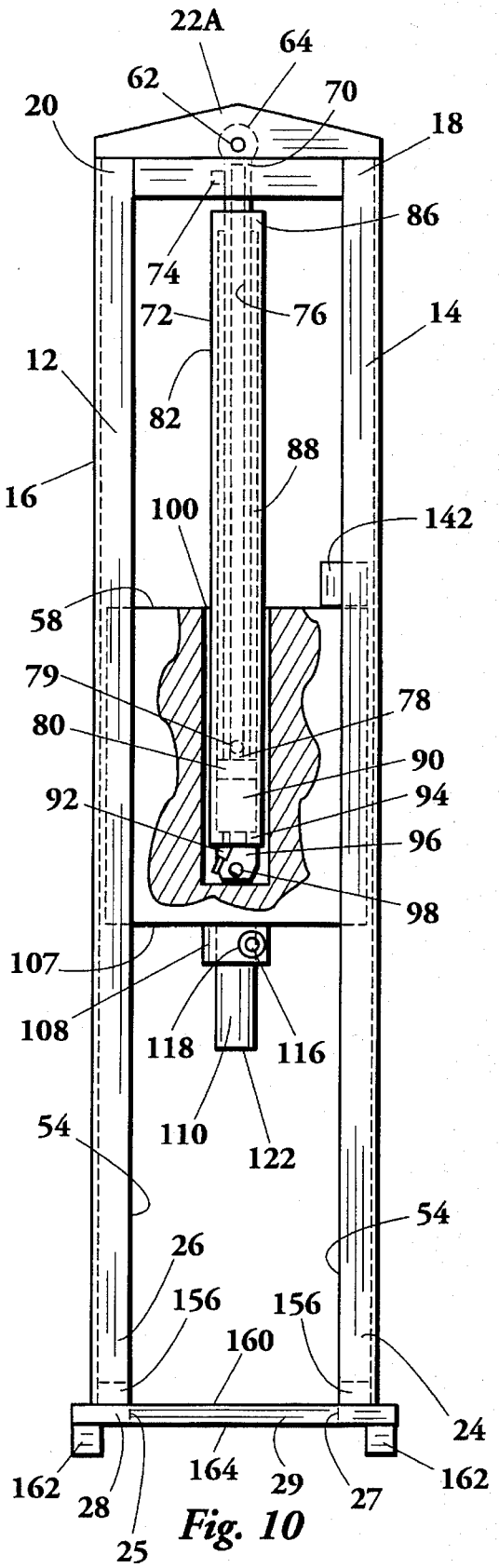
FIG. 10 is a partially cut away rear elevation of the concrete drop hammer attachment device, illustrating the weight raised.

The gas pressure $P_2$ is introduced into the lower cylinder chamber 90 by means of a gas which is pumped into the lower cylinder chamber 90 by way of a gas valve 92 provided on a closed bottom end 94 of the cylinder 82. Nitrogen is the preferred gas for introducing into the lower cylinder chamber 90. The lower cylinder chamber 90 is charged with nitrogen, and the original nitrogen charge remains in the lower cylinder chamber 90 thereafter. However, the gas pressure $P_2$ will differ depending on the hydraulic pressure $P_1$ and the resulting location of the cylinder 82 with respect to the head 80. For example, the gas pressure $P_2$ will be less when the cylinder 82 is lowered, as illustrated in FIG. 9, because the lower cylinder chamber 90 is increased in volume. Likewise, when the cylinder 82 is raised, as illustrated in FIG. 10, the gas pressure $P_2$ will be more because the lower cylinder chamber 90 is decreased in volume.

The bottom end 94 of the cylinder is provided with a downward oriented appendage 96. A bar bolt opening 98 is provided in the appendage 96.

Figure 12:
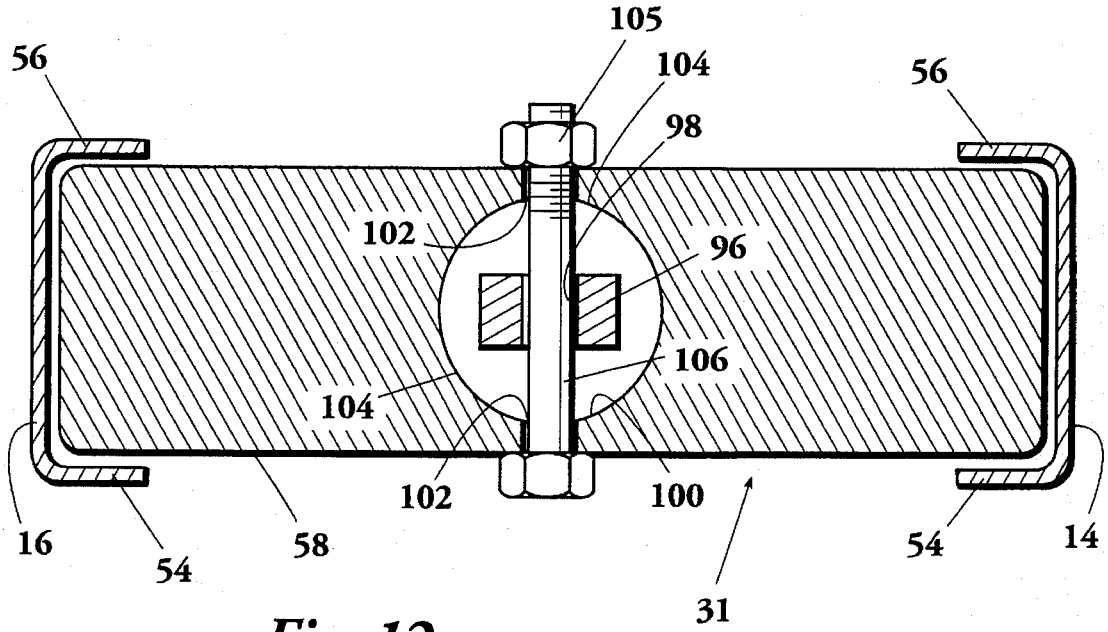
FIG. 12 is a cross:sectional view taken along line 12—12 of FIG. 1.
Figure 14:
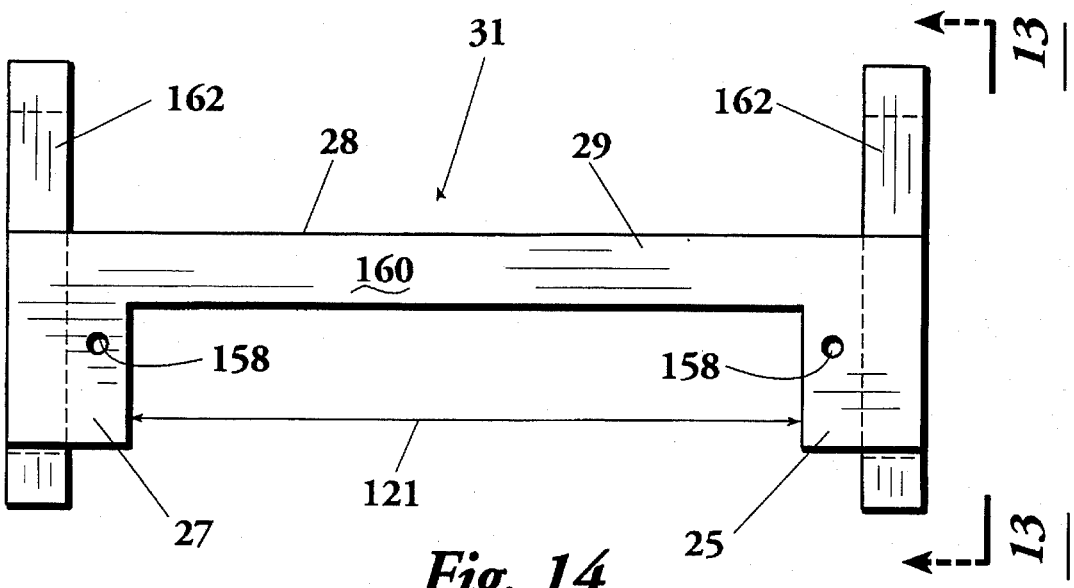
FIG. 14 is a top plan view of the lower frame member and runners shown detached from the device of FIG. 1.
Figure 13:
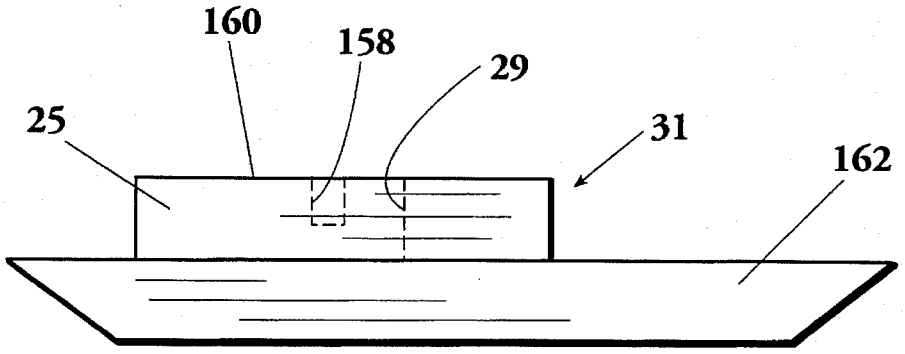
FIG. 13 is a left side view taken along line 13—13 of FIG. 14.

Referring now to FIGS. 1 and 12, the weight is provided with an upward facing cavity 100 into which the bottom end 94 of the cylinder 82 extends. A pair of weight openings 102 are provided in walls 104 of the cavity 100 so that the weight openings 102 align with each other and with the bar bolt opening 98 of the appendage 98. A bar bolt 108 extends consecutively through one of the weight openings 102, next through the bar bolt opening 98 and finally through the other weight opening 102 as a means of securing the weight 58 to the cylinder 82. A bar bolt nut 105 may then be threaded onto the bar bolt 106 to secure the bar bolt 106 within the openings 102 and 98.

Figure 11:
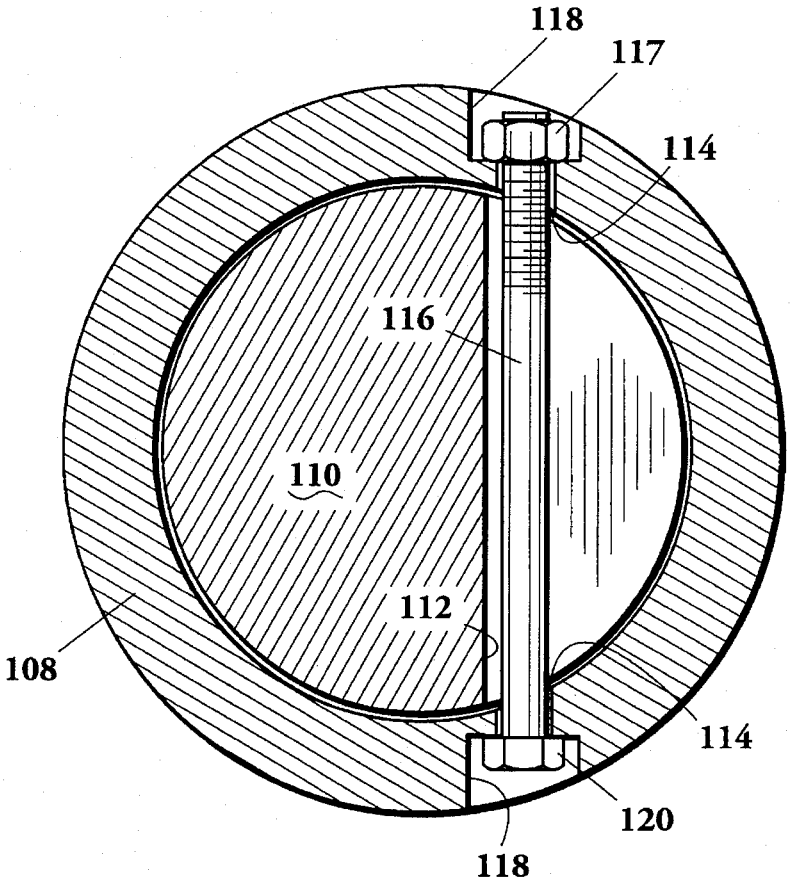
FIG. 11 is a cross-sectional view taken along line 11—11 of FIG. 1.

Referring now to FIGS. 1 and 11, a lower surface 107 of the weight 58 is provided with a downward oriented sleeve 108. The sleeve 108 is hollow so that it may receive a breaking tool 110 therein. The breaking tool 110 is provided with a notch 112 which aligns with a pair of sleeve openings 114 provided in the sleeve 108. A tool retaining bolt 116 inserts consecutively through one of the sleeve openings 114, then through the notch 112 and finally through the other sleeve opening 114 as a means of securing the breaking tool 110 to the weight 58. A tool retaining nut 117 threads onto the bolt 116 to secure it within the sleeve openings 114.

The sleeve 108 is provided externally with a pair of depressions 118, such that one of the depressions 118 is associated with and encircles each of the sleeve openings 114. When the tool retaining bolt 116 is secured within the sleeve openings 114, a head 120 of the tool retaining bolt 116 is located in one of the depressions 118 and the tool retaining nut 117 is located in the other depression 118. The depressions 118 protect the tool retaining bolt and nut 116 and 117 from being damaged as the weight 58 falls to the ground, as will be more fully explained hereafter.

As previously described, the lower frame member 28 is "U" shaped, and has an open span 121 located between its two legs 25 and 27. The breaking tool 110 passes through this open span 121 as the weight 58 falls, thus allowing a lower end 122 of the breaking tool 110 to impact the ground, or to impact asphalt, cement, etc located on the ground.

Figure 8:
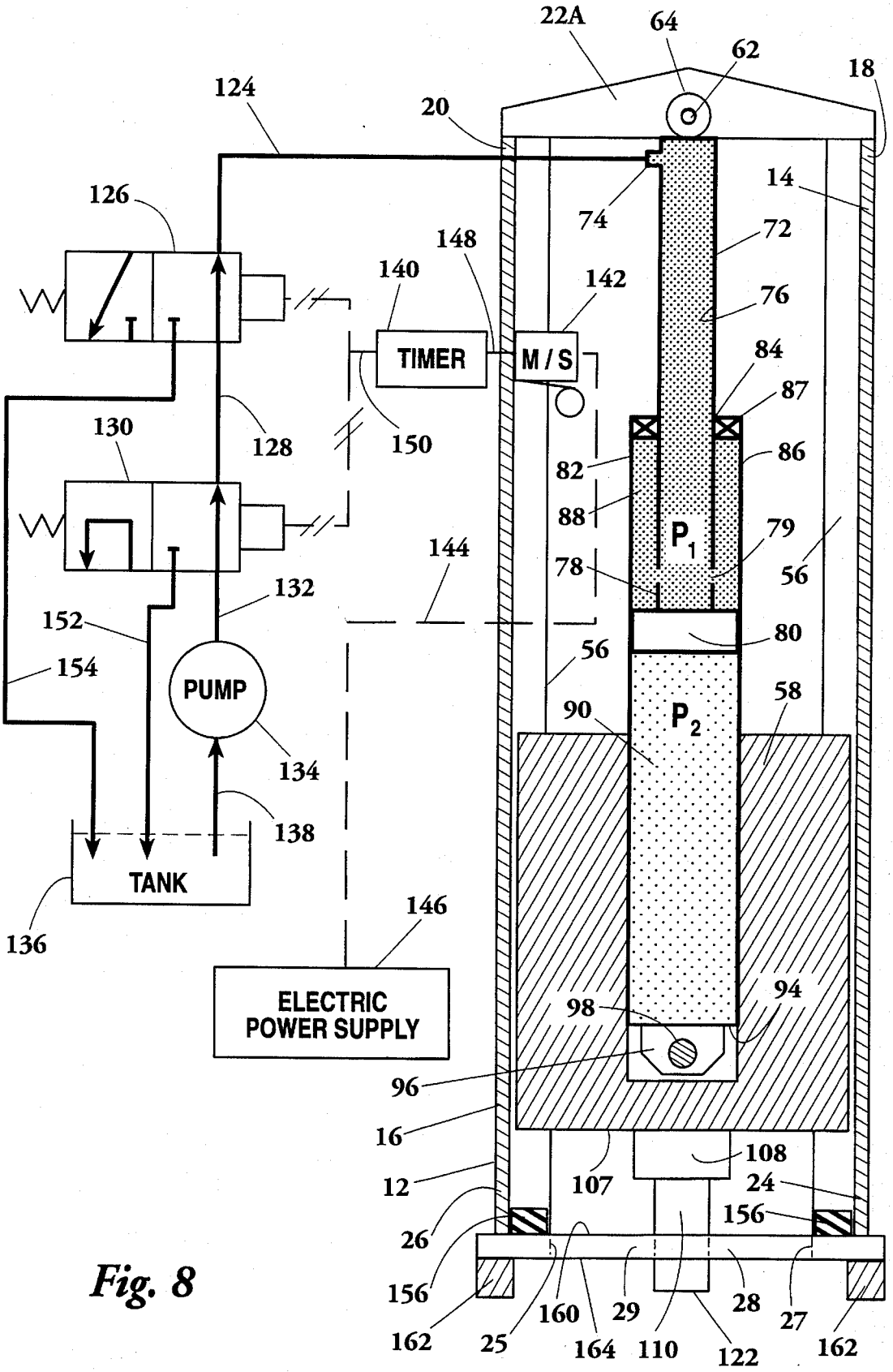
FIG. 8 is a diagram of the concrete drop hammer attachment device and its associated hydraulic and electrical systems.

Referring now to FIG. 8, the function of the device 10 will be more fully explained. A first hydraulic line 124 attaches by one of its ends to the nipple 74 and by its other end to a dump valve 126. The dump valve 126 is preferably a dual port, solenoid type valve which is normally open, as illustrated in FIG. 8. When open, the dump valve 126 allows hydraulic fluid to flow through the first hydraulic line 124, the nipple 74, the rod chamber 76 and into the upper cylinder chamber 88. When hydraulic fluid flows into the upper cylinder chamber 88, this causes $P_1$ to exceed $P_2$, which forces the cylinder 82 upward and causes the attached weight 58 and breaking tool 110 to be lifted upward from the ground.

Hydraulic fluid is supplied to the dump valve 126 via a second hydraulic line 128 which attaches on one of its ends to the dump valve 126 and on its other end to a directional valve 130. The directional valve 130 is also preferably a dual port, solenoid type valve which is normally open, as illustrated in FIG. 8. When open, the directional valve 130 allows hydraulic fluid to flow through the second hydraulic line 128 to the dump valve 126, and from there into the upper cylinder chamber 88, as previously described.

Hydraulic fluid is supplied to the directional valve 130 via a third hydraulic line 132 which attaches on one of its ends to the directional valve 130 and attaches on its other end to a hydraulic pump 134. The hydraulic pump 134 receives hydraulic fluid from a hydraulic fluid tank 136 via a fourth hydraulic line 138 attached by one of its ends to the hydraulic pump 134 and by its other end to the tank 136. Hydraulic fluid contained in the tank 136 moves consecutively through the pump 134 and through the third hydraulic line 132 when the hydraulic pump 134 is functioning.

Normally, the pump 134 and the tank 136 are located on and are a part of the skid steer 32 so that the third hydraulic line 132 runs from the device 10 to skid steer 32 and must be connected or disconnected each time the device 10 is attached to or detached from the skid steer 32.

Both the dump valve 126 and the directional valve 130 are normally open and are closed by electricity supplied by a timer 140 which in turn is activated by a trip switch 142. The trip switch 142 is provided with power via an electrical connection 144 from an electrical power supply 146 which is normally provided on and is a part of the skid steer 32. Similar to the third hydraulic line 132, the electrical connection 144 must be connected or disconnected each time the device 10 is attached to or detached from the skid steer 32.

The trip switch 142 is attached on one of the upright frame members 14 or 16 at a location near the upper end, either 18 or 20, so that as the weight 58 is lifted above the ground to its lifted position, as illustrated in FIG. 10, the weight 58 trips the trip switch 142. The trip switch 142 may be one of any of various types. For example, it may be a manual switch, such as a hydraulic switch, or it may be electronic, such as a photoelectric eye or it may be electrical, such as a contact switch. When the switch 142 is tripped, an electrical signal travels from the switch 142 via a second electrical connection 148 to the timer 140 which in turn provides electricity via a third electrical connection 150 to both the dump valve 126 and the directional valve 130. Electricity is supplied to the valves 126 and 130 for only a brief period of time, normally about one second, before the timer 140 resets itself and again removes the electricity from the valves 128 and 130. During the brief period when electricity is supplied to the valves 126 and 130, both valves 126 and 130 simultaneously close. When electricity is removed from them, both of the valves 126 and 130 simultaneously open again.

When the directional valve 130 closes, hydraulic fluid ceases to flow to the second hydraulic line 128, but rather returns to the tank 136 via a recycle line 152 attached by one of its ends to the directional valve 130 and attached by its other end to the tank 138.

When the dump valve 126 closes, hydraulic fluid instantaneously moves out of the upper cylinder chamber 88 via the same route it entered, moving back through the dump valve 126 and finally to the tank 136 via a dump line 154 which is connected on one of its ends to the dump valve 126 and on its other end to the tank 136. Movement of hydraulic fluid out of the upper cylinder chamber 88 is aided by the gas pressure $P_2$ which greatly exceeds the hydraulic pressure $P_1$ when the dump valve 126 is closed.

Similar to the third hydraulic line 132 and the electrical connection 144, both the recycle line 152 and the dump line 154 must be connected or disconnected each time the device 10 is attached to or detached from the skid steer 32.

The rapid movement of hydraulic fluid out of the upper cylinder chamber 88 also allows the cylinder 82, the attached weight 58 and the attached breaking tool 110 to fall downward toward the ground, allowing the breaking tool 110 to impact the surface which is to be broken up. In order to cushion the impact of the weight 58 striking the frame 12, as might occur in the situation where the breaking tool 110 does not impact an underlying surface, each of the legs 25 and 27 of the lower frame member 28 is provided with a stop 156 which the lower surface 107 of the weight 58 contacts as the weight 58 falls to its lowered position instead of striking against the lower frame member 28. Each of the legs 25 and 27 is provided with a hole 158 into which a bolt (not shown) is placed in order to secure the stop 156 to a top surface 160 of the lower frame member 28. The stops 156 are preferably constructed of rubber or some similar material.

When the timer 140 resets itself and electricity is removed from both valves 126 and 130, allowing them to reopen, hydraulic fluid refills the upper cylinder chamber 88, lifting the weight 58 and breaking tool 110. This cycle, i.e., lifting the weight 58 and allowing it to fall, is repeated over and over again. The skid steer 32 will be moved forward and backward between each cycle of lift and fall in order to move the device 10 over the surface to be broken up.

A pair of runners 162 is provided attached to a bottom surface 164 of the lower frame member 28. The runners 162 are generally parallel with each other and attach to and are generally parallel with the legs 25 and 27. The device 10 rests upon the runners 162 and the runners 162 allow the device 10 to be dragged or scooted across a surface more easily. Ends of the runners 162 are preferably tapered to allow the runners 162 to move across a surface more easily.

While the invention has been described with a certain degree of particularity, it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. A device for attachment to a skid steer to be used for breaking up a surface comprising:

attachment means provided on the device for removably attaching the device to a skid steer, a weight being movably provided on said device, hydraulic means being attached to said weight, said weight being moved upward to a lifted position when hydraulic fluid is supplied to said hydraulic means and said weight falling downward to a lowered position when hydraulic fluid is removed from said hydraulic means, a dump valve being hydraulically connected to said hydraulic means such that hydraulic fluid is supplied to said hydraulic means when said dump valve is open and hydraulic fluid is removed from said hydraulic means when said dump valve is closed, a directional valve being connected to said dump valve such that hydraulic fluid flows to said dump valve only when said directional valve is open, a switch provided on said device such that said switch is tripped when said weight reaches its lifted position, a timer being connected to and activated by said switch when said switch is tripped, said timer being connected to said dump valve and to said directional valve so that when the timer is activated the timer causes both the dump valve and the directional valve to momentarily close before the timer resets itself and allows the valves to reopen; and said hydraulic means further comprising a hollow rod being suspended on said device by a first end of said rod, a hollow cylinder movably capturing a second end of said hollow rod, said cylinder being provided with an upper cylinder chamber above said second end, a nipple being provided on said first end in order to provide fluid communication between said dump valve and a rod chamber provided within said hollow rod, and said second end of said hollow rod being provided with at least one perforation in order to provide fluid communication between said rod chamber and said upper cylinder chamber.

2. A device according to claim 1, wherein the hydraulic means further comprises:

said cylinder being provided with a lower cylinder chamber below said second end, and said lower cylinder chamber being provided with means for admitting gas into said lower cylinder chamber.

3. A device for attachment to a skid steer to be used for breaking up a surface on the ground comprising:

attachment means for removably attaching the device to a skid steer;

a weight movably provided on the device such that the weight moves between an upward lifted position and a downward lowered position, hydraulic means for lifting said weight, said hydraulic means for lifting said weight being hydraulically connected to and controlled by a dump valve so that said weight is lifted when the dump valve is open and said weight falls when the dump valve is closed, said dump valve being hydraulically connected to a directional valve, said directional valve being connected to a hydraulic tank provided on the skid steer, a timer being electrically connected to both said dump valve and said directional valve in order to simultaneously close both valves for a predetermined period of time before the timer resets itself and allows the valves to reopen, said timer being electrically connected to a switch provided on the device, said weight tripping said switch when the weight is raised to its lifted position, a breaking tool being provided on the weight so that the breaking tool impacts the ground when the weight falls to its lowered position, a frame, said attachment means being permanently attached to said frame, said weight movably retained within said frame, said switch being attached to said frame, and said hydraulic means for lifting said weight further comprising a hollow rod having two sealed ends, a rod chamber being provided between said ends; said rod being suspended by a first end to at least one upper frame member provided on said frame, a second end of said hollow rod being movably captured within a cylinder so that the first end of the hollow rod is external to the cylinder and the second end of the hollow rod is within the cylinder, an upper cylinder chamber being provided within the cylinder above said second end and a lower cylinder chamber being provided within the cylinder below said second end, nipple means provided in said first end of said hollow rod, said nipple means providing fluid communication through said rod to said rod chamber, and at least one perforation being provided in said second end of said hollow rod in order to provide fluid communication between said rod chamber and said upper chamber.

4. A device according to claim 3 further comprising:

valve means being provided on said cylinder for admitting gas into said lower cylinder chamber.

5. A device according to claim 3 wherein said nipple means is hydraulically connected to said dump valve.

6. A device according to claim 5 further comprising:

at least one stop being provided on a lower frame member of said frame between said frame and said weight in order to cushion the impact of the weight with the frame.

7. A device according to claim 6 wherein said lower frame member further comprises:

two horizontal and parallel legs each being attached by one of their ends to a bottom portion to form a "U" shaped lower frame member, said "U" shaped lower frame member being provided with an open span between said legs, and said breaking tool passing through said span as said weight falls to its lowered position.

8. A device according to claim 7 further comprising runners being provided on a bottom surface of said lower frame member.

* * * * *